United States Patent [19]

Shaanan et al.

[11] Patent Number: 4,936,014

[45] Date of Patent: Jun. 26, 1990

[54] UTILITY KNIFE

[75] Inventors: Gad Shaanan, Westmount; Imre Grosz, Dollard-des-Ormeaux; Serge Provost, Ville St-Laurent, all of Canada

[73] Assignee: Johnson Level and Tool (Canada) Inc., Pointe-Claire, Canada

[21] Appl. No.: 333,979

[22] Filed: Apr. 6, 1989

[51] Int. Cl.[5] ..... B26B 1/00; B26B 1/04; B26B 1/08; B26B 1/010

[52] U.S. Cl. ..... 30/162; 30/329; 30/331; 30/335

[58] Field of Search ..... 30/162, 164, 329, 330, 30/331, 333, 335, 337

[56] References Cited

U.S. PATENT DOCUMENTS

| | | | |
|---|---|---|---|
| 2,313,598 | 3/1943 | Stock . | |
| 3,765,089 | 10/1973 | Ibata | 30/162 |
| 3,927,473 | 12/1975 | Braginetz | 30/162 |
| 4,005,525 | 2/1977 | Gringer . | |
| 4,517,741 | 5/1985 | Castelluzzo | 30/162 |
| 4,604,805 | 8/1986 | Krieger | 30/329 |

*Primary Examiner*—Douglas D. Watts
*Assistant Examiner*—Paul M. Heyrana, Sr.
*Attorney, Agent, or Firm*—Samuel Meerkreebs

[57] ABSTRACT

A utility knife comprises a hollow casing formed by a pair of elongated members pivotally mounted one to the other at one end of the casing. A blade passage is provided at another end of the casing. The elongated members are adapted for movement in substantially parallel planes between aligned closed functional and open diverging positions. The casing is provided with a mechanism adapted to carry and selectively position a blade. The utility knife further comprises a locking member pivotally mounted to one of the elongated members and adapted in a closed position thereof to secure the elongated members in their aligned closed position. A pin extending inwardly from one of the side arms of the locking member is adapted to cooperate with a camming surface provided on the other one of the elongated members in order that, upon rotational movement of the locking member away from the closed position thereof, the elongated members are forcedly divergingly pivoted one with respect to the other about the other end of the casing and away from the aligned closed position thereof. As the spreading of the elongated members has been initiated by the pivot of the locking member the manual spreading of the enlongated members towards the full open diverging blade removal and replacement position thereof is facilitated as well as reduced. The elongated members interlock at the blade passage to prevent the lateral spreading of the casing during use.

28 Claims, 2 Drawing Sheets

UTILITY KNIFE

BACKGROUND OF THE INVENTION

1. Field of the Invention

The present invention relates to utility knives of the type having a retractable blade and, more particularly, to those having a removable and replaceable blade.

2. Description of the Prior Art

Utility knives tend to have the following characteristics. Retractability of the blade within the casing of the knife provides safety thereto when it is not in use and may also prolong the life of the blade. Sturdiness of the casing of the utility knife and of the blade mounting mechanism is also an important asset if the knife is to be used for heavy duty cutting operations. Removability and replaceability of the blade in the utility knife is an economical feature as the same casing can be used over and over since only the worn blades have to be replaced. Ideally, the blade of such utility knives can be replaced quickly, easily and safely. Two basic casing general designs are basically presently known and used for achieving some of the above-mentioned objects.

The first type of utility knife comprises a casing having two separate complementary halves which are secured together by a screw or by a nut and bolt arrangement. These utility knives thus require tools to disassemble the casing to access the worn blade in order to remove it and replace it with a new one. Furthermore, a certain assembly is required when the two halves of the casing are put back together. Therefore the replacement of a blade for this type of utility knife is time consuming apart from necessitating the usage of tools.

In a second type of utility knife, the two casing halves thereof are pivotally joined one to the other at an end thereof. Means are provided at the end of the casing opposite the pivot to maintain the two halves together when the utility knife is equipped with a functional blade. These means are released and the two halves are then divergingly spread apart in order to access the interior of the knife to replace the worn blade contained therein. Such utility knives are disclosed in U.S. Pat. No. 2,313,598, issued to H. Stock on Mar. 9, 1943, and in U.S. Pat. No. 4,005,525, issued to D. Gringer on Feb. 1, 1987. In Stock, a locking member is pivotally mounted to a first one of the casing halves. The other half is provided with a transverse stud adapted to engage an opening defined in the first half of the casing for protruding therefrom in order to be engaged and locked in a recess defined in the locking member upon the pivot thereof. In Gringer, the two casing halves are resiliently secured together. A protrusion is included on one half to provide a finger pull to overcome the resiliency and to thus divergingly separate the two casing halves. From the above, there is a need for a safer and sturdier locking mechanism for the two halves of the casing. Furthermore, it is often difficult to initiate the pivot of one half with respect to the other especially if the two casing halves mate well together when they are in their aligned, functional and handle-like position.

SUMMARY OF THE INVENTION

It is therefore an aim of the present invention to provide a utility knife of the type wherein the two mating casing halves are pivotally mounted together and which includes a simple, sturdy and reliable locking member therefor.

It is also an aim of the present invention to provide a utility knife having a locking member which initiates the diverging spreading apart of the two casing halves one with respect to the other upon a pivot of the locking member from a locked to an unlocked position thereof.

It is a further aim of the present invention to provide a utility knife which does not require any tool to open the casing thereof in order to remove and replace a worn blade.

It is still a further aim of the present invention to provide a utility knife which is of the retractable blade-type.

It is still a further aim of the present invention to provide a utility knife having a casing which cannot be opened unless the locking member is in its unlocked position and unless the blade is in its retracted sheathed position.

A construction in accordance with the present invention comprises a utility knife which includes a hollow casing having a blade passage at one end thereof. The hollow casing also includes first and second elongated members which are pivotally mounted one to the other at another end of the casing. The elongated members are adapted to move in substantially parallel planes between aligned closed functional and open diverging positions. The casing is provided with means adapted to carry and selectively position a blade. The utility knife further comprises a locking member which is pivotally mounted to the first elongated member and which is adapted in one position thereof to secure the elongated members in the aligned closed position thereof. Cooperating means are provided on the second elongated member and on the locking member and are adapted upon a pivot of the locking member away from the one position thereof to divergingly move the elongated members about the other end of the casing away from the aligned closed position thereof. This thus facilitates the manual spreading of the elongated members towards the full open diverging blade removal and replacement position thereof.

In a more specific construction in accordance with the present invention, the cooperating means of the utility knife comprises an arrangement of a pin and of a camming surface which are provided on one and the other one of the locking member and the second elongated member. Upon the pivot of the locking member, the pin acts on the camming surface to divergingly spread the elongated members.

In a still more specific construction in accordance with the present invention, the camming surface defines a recess at the end thereof corresponding with the position of the pin when the locking member is in the one position thereof. Therefore, when the elongated members are in the aligned closed position thereof and when the pin nests in the recess, the elongated members are locked in their aligned closed position.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
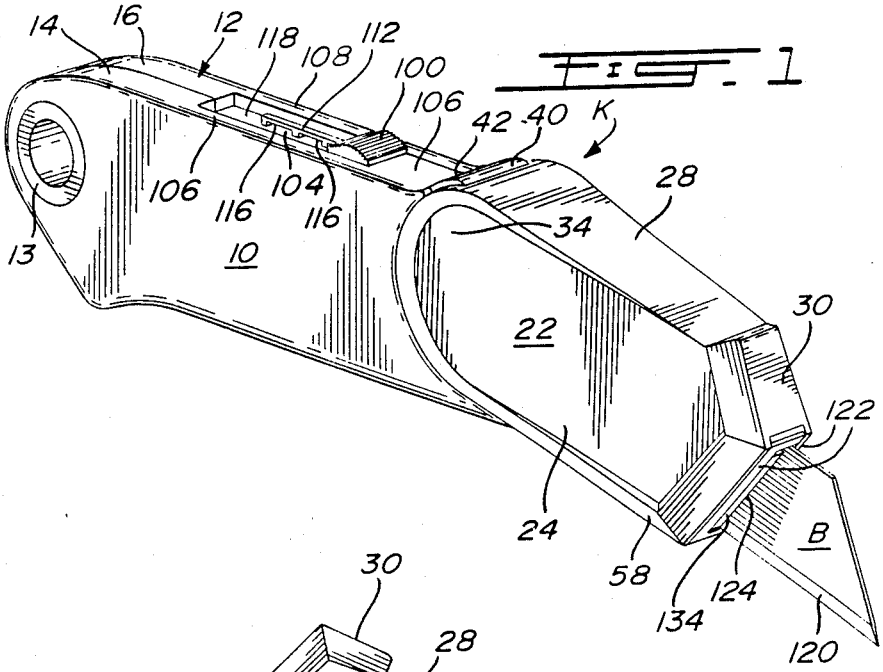
FIG. 1 is a perspective view showing a utility knife according to the present invention in which the blade thereof is in its extended unsheathed position.
Figure 2:
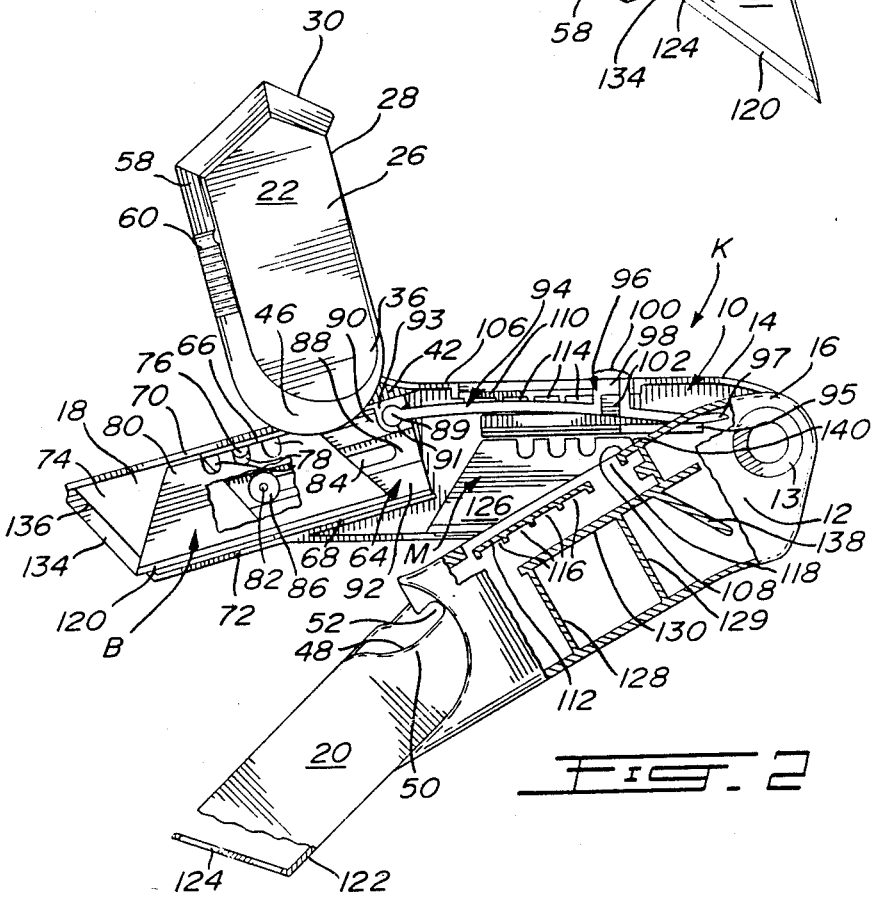
FIG. 2 is an elevation view partly broken away of the utility according to the present invention in its open diverging blade removal and replacement position.

Referring generally to FIGS. 1 and 2, a retractable blade utility knife K comprises carrier and cover portions 10 and 12 respectively. These portions 10 and 12 mate together to form an elongated hollow casing contoured to provide the utility knife K with an appropriate handle. The carrier and cover portions 10 and 12 are joined by way of a pivot 13 one to the other at respective end parts 14 and 16 thereof. When the utility knife K is in its closed position, as illustrated in FIG. 1, the carrier and cover portions 10 and 12 are secured together at respective second end parts 18 and 20 thereof by a locking member generally indicated by 22 which is to be further described hereinafter. The carrier and cover portions 10 and 12 are generally made of a zinc alloy material, whereas the locking member 22 is of a plastic material.

Figure 4:
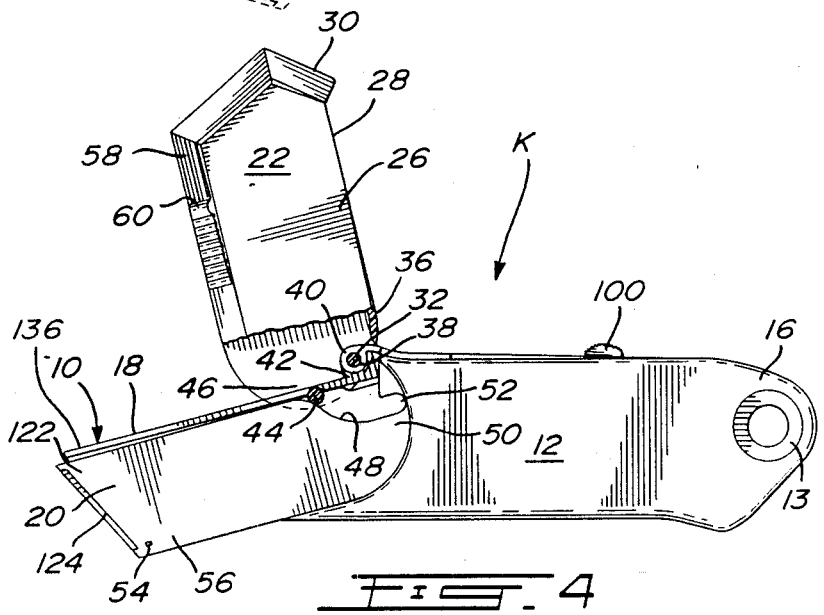
FIG. 4 is an elevation view partly broken away showing the position of the two casing halves of the utility knife following the unlocking pivot of the locking member and also illustrating the pin and camming surface arrangement which initiates the separation of the casing halves and pivots the latter to reach this just mentioned position thereof.

The locking member 22 includes a pair of side arms 24 and 26 which are joined in a spaced apart parallel manner by a top wall 28 and an upper front wall 30. As seen in FIG. 4, a pair of studs 32 extend at right angles inwardly of respective upper rear parts 34 and 36 of the side arms 24 and 26. The studs 32 are rotatably engaged in an opening 38 transversely defined through a rib 40 integrally formed on a middle top section 42 of the carrier portion 10. A pin 44 extends inwardly from a middle rear part 46 of the side arm 26 of the locking member 22 as seen in FIG. 4. The pin 44 is adapted to engage a camming surface 48 defined in a top side section 50 of the cover portion 12. The camming surface 48 also defines a recess 52 within which the pin 44 is confined when the locking member 22 is in its lowered position which is seen in FIG. 1.

When the locking member 22 is in its lowered position, the carrier and cover portions 10 and 12 are thus locked one to the other in their mating, closed, functional position. In order to maintain the locking member 22 in its lowered position, a pair of small studs 54 each extends outwardly from a lower front surface 56 of the carrier and cover portions 10 and 12, whereby the angled front lower edges 58 of both side arms 24 and 26 therefore overlie the small studs 54 and thus releasably secure the locking member 22 in its lowered position.

Figure 3:
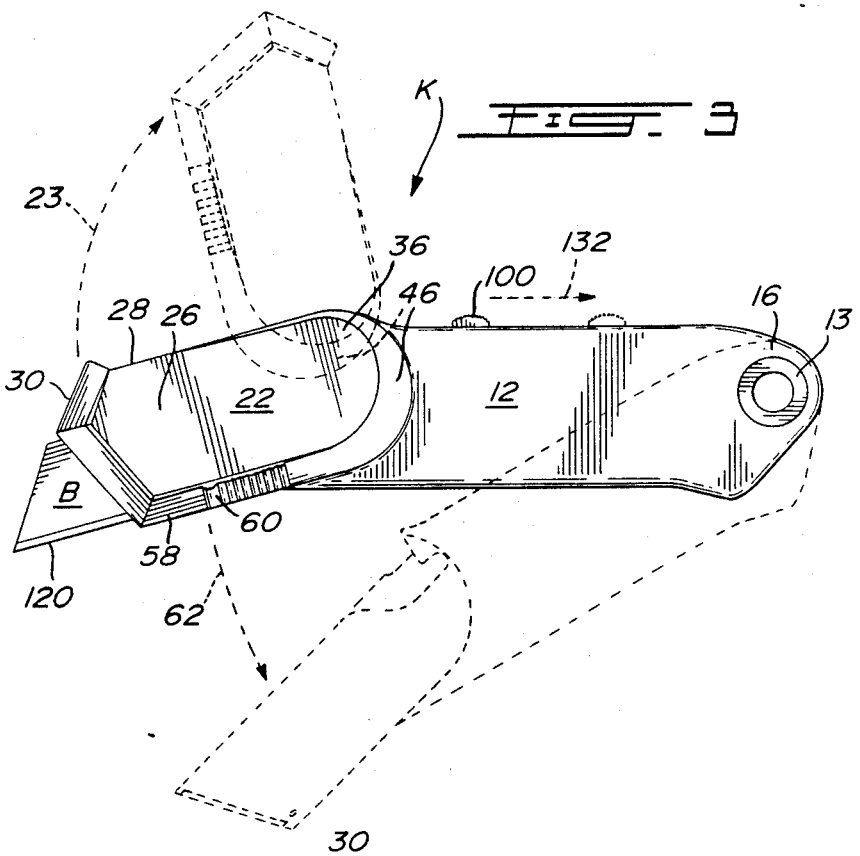
FIG. 3 is an elevation view showing the blade of the utility knife in its extended unsheathed position and showing in dotted lines the steps for unlocking and opening the utility knife to reach the blade removal and replacement position thereof generally shown in FIG. 2.

When a small upward force is applied to either one of the front lower edges 58 of the side arms 24 and 26, the locking member 22 disengages from the small studs 54 and can then be pivoted from its lowered to its raised position as respectively seen in FIG. 3 in full and in dotted lines.

A series of serrations 60 are defined on the lower front edge 58 of the side arm 26 to provide a grip and therefore leverage for the thumb of the user in order to facilitate the disengagement of the locking member 22 from the small studs 24.

When the locking member 22 is pivoted upwardly along arrow 23 (see FIG. 3), the pin 44 thereof first is released from the recess 52 defined in the cover portion 12. The pin 44 then acts on the camming surface 48 to urge the cover portion 12 slightly away from the carrier portion 10 as seen in FIG. 4.

Once the separation of the carrier and cover portions 10 and 12 has been initiated by the coaction of the pin 44 and of the camming surface 48, the carrier and cover portions 10 and 12 can be easily, manually pivoted along a direction shown by arrow 62 in FIG. 3 towards a final spread apart position thereof as shown in FIG. 2.

Now referring to FIG. 2, the carrier portion 10 is internally provided with a generally planar blade carriage 64 having parallel and spaced upper and lower flanges 66 and 68 extending at right angles therefrom and by way of which the blade carriage 64 is slidably engaged between upper and lower equidistant guideways 70 and 72 which extend at right angles from an inner surface 74 of the second end part 18 of the carrier portion 10.

A blade B is mounted to the blade carriage 64 within the flanges 66 and 68 thereof which transversely restrain the blade B in the carriage 64. The blade B is maintained in position in the blade carriage 64 by way of a lug 76 extending towards the blade B from the upper flange 66 of the blade carriage 64 and which engages any one of a series of notches 78 defined in the top section 80 of the blade B. The blade carriage 64 and the blade B can therefore slide longitudinally between the guideways 70 and 72.

The blade carriage 64 is slidably mounted to the inner surface 74 of the second end part 18 of the carrier portion 10 by way of a pin 82 extending at right angles from the inner surface 74 and through a longitudinal groove 84 defined in the blade carriage 64. A washer 86 is press-fitted to a top free end of the pin 82 for slidably securing the blade carriage 64 to the carrier portion 10. It is noted that the groove 84 is defined in a recess 88 of the blade carriage 64 in order that an upper surface of the washer 86 is coplanar with upper surfaces of portions 90 and 92 of the blade carriage 64 disposed on each side of the recess 88 thereof.

The position of the blade carriage 64 is controlled by a plastic, bowed, resilient member 94 pivotally mounted thereto. A cylindrically shaped end 89 of the resilient member 94 is slidably mounted in an aperture 91 defined in a projecting part 93 of the portion 90 of the blade carriage 64. The aperture 91 is adapted to allow a slight pivot of the resilient member 94 with respect to the blade carriage 64. A free end 97 of the resilient member 94 which has a reverse bow with respect thereto is supported by a support flange 95 on which the free end 97 can longitudinally be conveyed.

A control tab 96 for longitudinally positioning the resilient member 94 extends from the convex side thereof. The control tab 96 includes a neck 98, a thumb tab 100 and side tabs 102. An elongated channel 104 is jointly defined through top sides 106 and 108 of the carrier and cover portions 10 and 12 respectively. Retention ribs 110 and 112 extend in the channel 104 respectively from the inner surfaces of the top sides 106 and 108. The retention ribs 110 and 112 respectively define on their underside a series of notches 114 and 116. The neck 98 of the resilient member 94 is adapted to longitudinally slide between the retention ribs 110 and 112.

The thumb tab 100 which is of larger transverse dimension than the neck 98 is adapted to overlie the upper surfaces of the retention ribs 110 and 112 when the thumb tab 100 is depressed. The side tabs 102 are adapted to be engaged under the resiliency of the resilient member 94 in the notches 114 and 116 in order to longitudinally restrain and thus lock the resilient member 94 and therefore the blade carriage 94 and the blade B into one of the selective blade settings provided by the different notches.

Therefore, when the thumb tab 100 is depressed, the bowed resilient member 94 slightly flattens out to thus disengage the side tabs 102 from a set of notches 114 and 116, whereby the resilient member 94 can be longitudinally displaced along the support flange 94 to a desired blade setting. The thumb tab 100 is then released and the side tabs 102 engage in a proper set of notches. It is noted that the thumb tab 100 can only be depressed a limited distance as its underside contacts the upper surface of the retaining ribs 110 and 112.

When the carrier and cover portions 10 and 12 are pivoted one with respect to the other, the side tab 102 facing the cover portion 12 clears the latter by way of a passage 118 defined rearwardly of the retention rib 112 as seen in FIGS. 1 and 2. The retention rib 110 thus rearwardly extend a notch further than the retention rib 112. It is easily seen that the carrier and cover portions 10 and 12 can therefore only be pivoted when the resilient member 94 is in its rearwardmost position which corresponds to the retracted sheathed position of the blade B in the utility knife K due to the fact that the side tab 102 facing the cover portion 12 can only clear the channel 104 by way of the passage 118 which also corresponds to the retracted sheathed position of the blade B. This prevents the knife from being opened when the blade B is in its unsheathed extending position, that is when a cutting edge 120 thereof is exposed.

For further ensuring that the utility knife K is not open when the blade is in one of its extended positions, the cover portion 12 defines at a front end 122 thereof an elongated passage 124 adapted for receiving the blade B as it is moved from a retracted to an extended position thereof. The blade passage 124 is further adapted to receive a locking tab 134 which projects from a front end 136 of the carrier portion 10.

The locking tab 134 and the blade passage 124 respectively act as male and female interlocking (counter) parts which prevent the lateral spreading of the carrier and cover portions 10 and 12 one with respect to the other under pressure exerted during use of the knife K. Furthermore, the blade passage 124 is angularly oriented to allow it to be formed in its entirety by a simple molding process without resorting to side coring techniques, that is it can be manufactured without any side cores in the diecasting mold.

A blade magazine M containing a number of spare blades 126 is provided in the carrier portion 10 rearward of the blade carriage 64 and lower than the support flange 95 as seen in FIG. 2. A series of flanges 128, 129, 130 and 138 extend inwardly from the first end part 16 of the cover portion 12 to maintain the spare blades 126 of the blade magazine M in position when the utility knife K is in its closed functional position.

The flange 130 is two-levelled to complement the two-level edge of the support flange 95 to ensure a proper mating thereof. A further flange (not shown) extends inwardly from the first end part 14 of the carrier portion 10 so as to face and generally abut the flange 138 of the cover portion 12 when the carrier and cover portions 10 and 12 are in mating engagement. These corresponding flanges are defined parallel to the rear edges 140 of the spare blades 126 to prevent them from moving rearward towards the pivot 13 of the knife K.

To summarize, in order to remove and replace the blade B, the thumb tab 100 is depressed and displaced to its rearwardmost position thereof as indicated by the arrow 132 in FIG. 3. Then, the locking member 22 is pivoted upwardly along the arrow 23 using the grip 60. The pin 44 is first disengaged from the locking recess 52 and then acts during the pivot of the locking member 22 on the camming surface 48 to force the diverging pivot of the carrier and cover portions 10 and 12 one with respect to the other until the portions 10 and 12 are positioned as shown in FIG. 4. The cover portion 12 can then be moved with respect to the carrier portion 10 along the arrow 62 until it has reached the general position thereof shown in dotted lines in FIG. 3.

The worn blade B can then be removed and replaced by a new blade 126 taken from the blade magazine M. The cover portion 12 is then pivoted in a direction opposite that shown by the arrow 62 until the camming surface 48 contacts the pin 44 on the locking member 22. The locking member 22 is then pivoted in a direction opposite that shown by the arrow 23 in order to bring the carrier and cover portions 10 and 12 in mating engagement and to lock them together. The thumb tab 100 can then be depressed and longitudinally moved along a direction opposite that shown by the arrow 132 in order to expose the cutting edge 120 of the new blade B positioned in the blade carriage 64.

From the above, it is understood that blades are easily removed and replaced using the hereinabove described utility knife K. Furthermore, this is done in a safe way as the utility knife K cannot be opened unless the blade positioned in the blade carriage thereof is in its retracted sheathed position.

The locking member 22 which acts to initiate the relative spreading of the carrier and cover portions 10 and 12 also provides a locking feature by way of the recess 52 defined on the top side section 50 of the cover portion 12 rearward of the camming surface 48 in which the pin 44 can nest. The locking member 22 is releasably maintained in its lowered locking position by way of the small studs 54 cooperating with the front lower edges 58 of the side arms 24 and 26 thereof.

Since the carrier and cover portions 10 and 12 pivot one with respect to the other and do not completely separate as many utility knives do, the reassembly of the utility knife K after replacing a blade is facilitated. Most important, no tools are required in order to replace a blade when using a utility knife according to the present invention.

I claim:

1. A utility knife comprising a hollow casing having a blade passage at one end thereof and including first and second elongated members pivotally mounted one to the other at another end of said casing for movement in substantially parallel planes between aligned closed functional and open diverging positions, said casing being provided with means adapted for carrying and selectively positioning a blade, said utility knife further comprising a locking member pivotally mounted to said first elongated member and adapted in one position thereof for securing said elongated members in said aligned closed position thereof, cooperating means being provided on said second elongated member and on said locking member and adapted upon a pivot of said locking member away from said one position thereof for divergingly moving said elongated members about said other end away from said aligned closed position thereof thereby facilitating manual spreading of said elongated members towards said open diverging position thereof.

2. A utility knife as defined in claim 1, wherein said cooperating means comprises an arrangement of a pin and a camming surface provided on one and the other one of said locking member and said second elongated member whereby upon said pivot of said locking member, said pin acts on said camming surface for divergingly spreading said elongated members.

3. A utility knife as defined in claim 2, wherein said camming surface defines a recess at the end thereof corresponding with the position of said pin when said locking member is in said one position thereof, whereby when said elongated members are in said aligned closed position thereof and when said pin nests in said recess, said elongated members are locked in said aligned closed position thereof.

4. A utility knife as defined in claim 3, wherein said locking member comprises a pair of side arms adapted for extending in said one position of said locking member along outer front side surfaces of said elongated members.

5. A utility knife as defined in claim 4, wherein said camming surface is provided on said outer surface of said second elongated member and said pin is mounted on an inner surface of the side arm of said locking member associated with said second elongated member.

6. A utility knife as defined in claim 4, wherein retaining means are provided for securing said locking member in said one position thereof.

7. A utility knife as defined in claim 6, wherein said retaining means comprises at least a stud means extending from at least one of said elongated members for cooperating with a depression means defined on an inner side of an associated one of said pair of side arms.

8. A utility knife as defined in claim 1, wherein said locking member is made of a plastic material.

9. A utility knife as defined in claim 1, wherein said elongated members are made of a zinc alloy material.

10. A utility knife as defined in claim 1, wherein a grip means is provided on said locking member for facilitating the release thereof from said one position thereof.

11. A utility knife as defined in claim 10, wherein said grip means comprises serrations defined on a lower portion of an outer surface of at least one of said side arms.

12. A utility knife as defined in claim 1, wherein a blade magazine is provided in one of said elongated members near said other end of said casing.

13. A utility knife as defined in claim 1, wherein said casing at said one end thereof is provided with interlocking means on one and the other of said elongated members.

14. A utility knife as defined in claim 13, wherein said interlocking means comprises male and female angularly projecting parts, said female projecting part having the form of a frame extending transversely of the elongated member associated therewith and having a rectangular opening defined therein, said rectangular opening being adapted to receive said male projecting part when said elongated members are in said closed aligned position thereof, said blade passage being positioned substantially parallel to and intermediate of said male projecting part a first elongated side of said frame, said male projecting part being adjacent to a second elongated side of said frame opposite said first side thereof thereby preventing lateral spreading of said elongated members during use of said knife.

15. A utility knife as defined in claim 14, wherein said interlocking means are entirely formed by molding without resorting to side coring techniques.

16. A utility knife as defined in claim 1, wherein said means for carrying and positioning the blade comprises a guide means provided in one of said elongated members, a blade carriage means being slidably engaged in said guide means and adapted for receiving the blade, and a carriage positioning means for selectively positioning the blade between a retracted sheathed position thereof and at least an extended unsheathed position thereof wherein a cutting edge of the blade is exposed.

17. A utility knife as defined in claim 16, wherein said carriage means comprises an elongated plane surface for contactingly receiving a side of the blade, short longitudinal flanges extending from side edges of said plane surface, the blade being slidably engaged between said flanges at an upper edge and a lower cutting edge thereof for transversely restraining the blade in said carriage means, said carriage means further comprising a tab means extending from the flange associated with the upper edge of the blade, said tab means being adapted for engaging a notch means defined in the upper edge of the blade for the longitudinal restraint thereof in said carriage means.

18. A utility knife as defined in claim 16, wherein said carriage means comprises a longitudinal slot adapted to receive from one side thereof a pin means extending from said one of said elongated members, a washer means being adapted to engage said pin means on another side of said slot for securing said carriage means to said one of said elongated members, whereby the blade overlies said washer means.

19. A utility knife as defined in claim 16, wherein said carriage positioning means comprises an elongated bowed resilient member extending substantially longitudinally in said casing and pivotally mounted at one end thereof to said carriage means, a longitudinal support means in said one of said elongated members for supporting another end of said bowed resilient means which is movable thereon, said resilient member having an integral protrusion extending from a convex side thereof through a channel defined longitudinally in an upper side of said casing, said protrusion including a neck longitudinally slidable in said channel and a thumb tab on top of said neck and outside of said upper side of said casing, said thumb tab being of larger transverse dimension than said neck, latching tabs being provided laterally of said resilient member lower than a portion of said neck corresponding with said channel and adapted for engaging notches longitudinally provided on an underside of said upper side of said casing whereby said latching tabs are disengaged from one of said notches by depressing said thumb tab and thus said resilient member towards said support means and whereby said resilient member is longitudinally displaced in said casing along with the depressed thumb tab and is guided by said neck in said channel, thereby displacing the carriage means towards a desired blade position, said notches corresponding to the different said positions of the blade.

20. A utility knife as defined in claim 19, wherein said bowed resilient member is made of a plastic material.

21. A utility knife as defined in claim 19, wherein said channel is of larger transverse dimension at said other one of said elongated members for a part thereof corresponding with the side tab associated therewith when the blade is in the retracted sheathed position thereof thereby providing a passageway for said associated side tab, whereby said elongated members can only spread apart from said aligned closed position thereof to said diverging open position thereof when the blade is in the retracted sheathed position thereof.

22. A utility knife as defined in claim 25, wherein said one and said other one of said elongated members respectively correspond to said first and second elongated members and wherein said blade opening is defined in said second elongated member, thereby preventing said elongated members from being spread apart from said aligned closed position thereof unless the blade is in the retracted sheathed position thereof.

23. A utility knife as defined in claim 19, wherein a blade magazine is provided in said one of said elongated members lower than said support means and is adapted for receiving spare blades.

24. A utility knife as defined in claim 21, wherein means are provided in said magazine for maintaining the spare blades in position therein.

25. A utility knife as defined in claim 22, wherein said means include flange means extending from an inner surface of at least one of said elongated members, said ribs being adapted to border at least part of the longitudinal peripheral edge of each of the spare blades.

26. A utility knife as defined in claim 21, wherein means are provided in said other one of said elongated members opposite said blade magazine when said elongated members are in said aligned closed functional position thereof for substantially maintaining in position the spare blades contained therein.

27. A utility knife comprising a handle member including elongated complementary carrier and cover portions having a blade passage at one end thereof and being pivotally joined at another end thereof, said carrier portion comprising a guided retractable blade carriage means adapted for receiving a blade, carriage positioning means being provided for selective longitudinal movement of the blade between a retracted sheathed position and at least one extended unsheathed position through said passage, said utility knife further comprising a locking member pivotally mounted to one of said carrier and cover portions and adapted in one position thereof for securing said portions in an aligned closed position thereof, cooperating means being provided on another one of said portions and on said locking member, said cooperating means being adapted upon a pivot of said locking member away from said one position thereof for moving said elongated portions from said closed position thereof partly towards an open diverging position thereof, thereby facilitating manual spreading of said elongated portions towards said open diverging position thereof.

28. A utility knife comprising a hollow casing having a blade passage at one end thereof and including first and second elongated members pivotally mounted one to the other at another end of said casing for movement between aligned closed functional and open diverging positions, said casing being adapted for carrying a blade, said utility knife further comprising a locking member pivotally mounted to said first elongated member and adapted in one position thereof for securing said elongated members in said aligned closed position thereof, cooperating means being provided on said second elongated member and on said locking member and adapted upon a pivot of said locking member away from said one position thereof for divergingly moving said elongated members about said other end away from said aligned closed position thereof.

* * * * *